US006299918B1

(12) United States Patent
Morgese

(10) Patent No.: US 6,299,918 B1
(45) Date of Patent: Oct. 9, 2001

(54) PIZZA SERVER

(76) Inventor: Joseph Morgese, 711 Signal Mtn. Rd. P.M.B. #105, Chattanooga, TN (US) 37405

( * ) Notice: Subject to any disclaimer, the term of this patent is extended or adjusted under 35 U.S.C. 154(b) by 0 days.

(21) Appl. No.: 09/472,723

(22) Filed: Dec. 27, 1999

Related U.S. Application Data

(60) Provisional application No. 60/114,805, filed on Jan. 5, 1999, and provisional application No. 60/113,999, filed on Dec. 28, 1998.

(51) Int. Cl.[7] ..... B65D 85/00

(52) U.S. Cl. ..... 426/112; 426/115; 426/394; 206/551

(58) Field of Search ..... 426/112, 115, 426/122, 123, 126, 394, 420; 229/101.1–101.2, 107, 117.09, 117.13, 902, 903, 906, 938; 206/551

(56) References Cited

U.S. PATENT DOCUMENTS 3,335,846 * 8/1967 Mills ..... 206/551
5,098,013 * 3/1992 France et al. ..... 229/115
5,118,033 * 6/1992 Kula ..... 229/115
5,129,521 * 7/1992 Irigoite et al. ..... 206/551
5,165,171 * 11/1992 MacLean ..... 30/114
5,176,930 * 1/1993 Kannankeril et al. ..... 426/124
5,249,738 * 10/1993 Werth ..... 229/235
5,381,905 * 1/1995 Mallmamm et al. ..... 206/551
5,476,214 * 12/1995 Fisk, Jr. ..... 229/103
5,526,569 * 6/1996 Ancona ..... 30/169
5,605,231 * 2/1997 Borsboom et al. ..... 206/551
5,788,145 * 8/1998 Grahahm et al. ..... 229/113

* cited by examiner

*Primary Examiner*—Nina Bhat

(57) ABSTRACT

This pizza server(10) along with it's outer sleeve(22), provide a neater and more comfortable means of enjoying this fun food, as well as for it to stay warmer longer thanks to the outer sleeve(22) that slips on and off very easily. The absorbent liner(20) both in the sleeve(22) and on the pizza server(10) absorb the excess grease.

Thanks to the flap(12), you can handle the slice of pizza without touching it, and thanks to the crease(14) you can fold it so it won't flop.

During consumption, the pizza server(10) peels back from underneath the pizza, thanks to the crease(14) which seperates by use of a pull string or perforation(16) and tin strips(18) embedded in the plate(10)which help keep the plate folded away. An alternative peel-away method uses cross-wise perforations (24) about every two inches.

This pizza-server (10) will make a great advertising and promotion tool, by imprinting information on them and then handing them out to generate good-will.

14 Claims, 2 Drawing Sheets

PIZZA SERVER

CROSS REFERENCES

This application claims benefit to Provisional Application No. 60/114/805 filed Jan. 5, 1999, which also claims benefit of Provisional Application No. 60/113/999 filed Dec. 28, 1998.

The strongest cross reference would have to be the common, disposable paper or styrofoam plate. However, the plate at the heart of this invention is specifically designed with pizza in mind so that, instead of the plate being round, it is shaped like a pizza wedge and has special characteristics built in that will help you eat a slice of pizza.

BACKGROUND

1. Field of Invention

This invention relates to pizza, specifically with regards to a new way to handle pizza slices during consumption. This special plate is shaped like a wedge of pizza, and is inserted under the slice of pizza at the pie, and then, a specially designed flap folds over the crust.

Also, this plate may have a crease along the center lengthwise, if needed, to allow for the slice to be folded lengthwise as it is being picked up in order to keep the slice of pizza from flopping.

In one embodiment, the plate bottom can be bent and folded away, as the pizza gets consumed. The bottom of the plate is designed with a perforation or a pull-string along the crease at center lengthwise and so the bottom tears in half to facilitate it's being folded away. Also, tin is embedded into the plate to make it so that the plate stays folded as it is so desired.

In another embodiment, the plate bottom has cross-wise perforations about every two inches, which allows for the plate to be torn away bit by bit as the pizza gets consumed.

For either embodiment, the idea, is to enable the pizza-lover to enjoy this fun food, in a manner that generally would keep his hands from contacting the pizza, and in those environments that are normally not conducive to sitting at a table with utensils, such as concerts, fairs, sports events, etc. etc.

2. Description of Prior Art

Generally, only conventional methods, such as, plates, utensils, foldtop boxes, are being used.

With regards to larger pizza pies, where the pie gets cut up and served as wedge-shaped slices, this pizza server makes for a novel way of handling and eating this style of pizza. It makes for a neater way of eating this fun food and will be a hit at parties and concerts where plates and utensils would be cumbersome.

This pizza server can also be used with personal pan style pizzas that are round and small enough to handle and crusted all around the entire circumference, even though the shapes don't match.

Also, from an advertising and good-will generating point of view, it would be utilized in the same fashion as items such as calenders, keychains, etc., in that a pizza parlour would imprint his/her logo and messages on the pizza server and then give them out.

OBJECTS AND ADVANTAGES

Accordingly, several objects and advantages of my invention are to provide a way to eat pizza slices that would keep the hands from getting dirty and/or from being burned by handling the hot pizza.

This can be made of disposable material from a group comprising of corrugated cardboard, or styrofoam or heavy paper.

Pizza by the slice venders would be able to dispense this fun food in a neater and more comfortable fashion.

Also, this invention provides another medium for advertising, and generating good will by giving them out to customers.

Furthermore, a handy sleeve (optional) may be used to cover the pizza and the server so that the pizza could remain warm for longer periods. A liner in the sleeve and on the plate absorbs excess grease out of the pizza, and the sleeve helps to keep the pizza warmer, longer, by minimizing air contact.

Also, the sleeve provides a means to stack the individual slices one atop another for simpler handling. The sleeve may be boxlike or envelope like.

The pizza server creates such a situation that lends itself well for the use of a sleeve and thanks to this combination, makes for all of the aforementioned advantages.

This invention may also prove helpful for other types of food by simply modifying the shape to suit the food, such as stuffed pitas, sub sandwiches, anything where people could eat the food without getting their hands dirty.

Still further objects and advantages will become apparent from a consideration of the ensuing description and accompanying drawings.

REFERENCE NUMERALS

Figure 1:
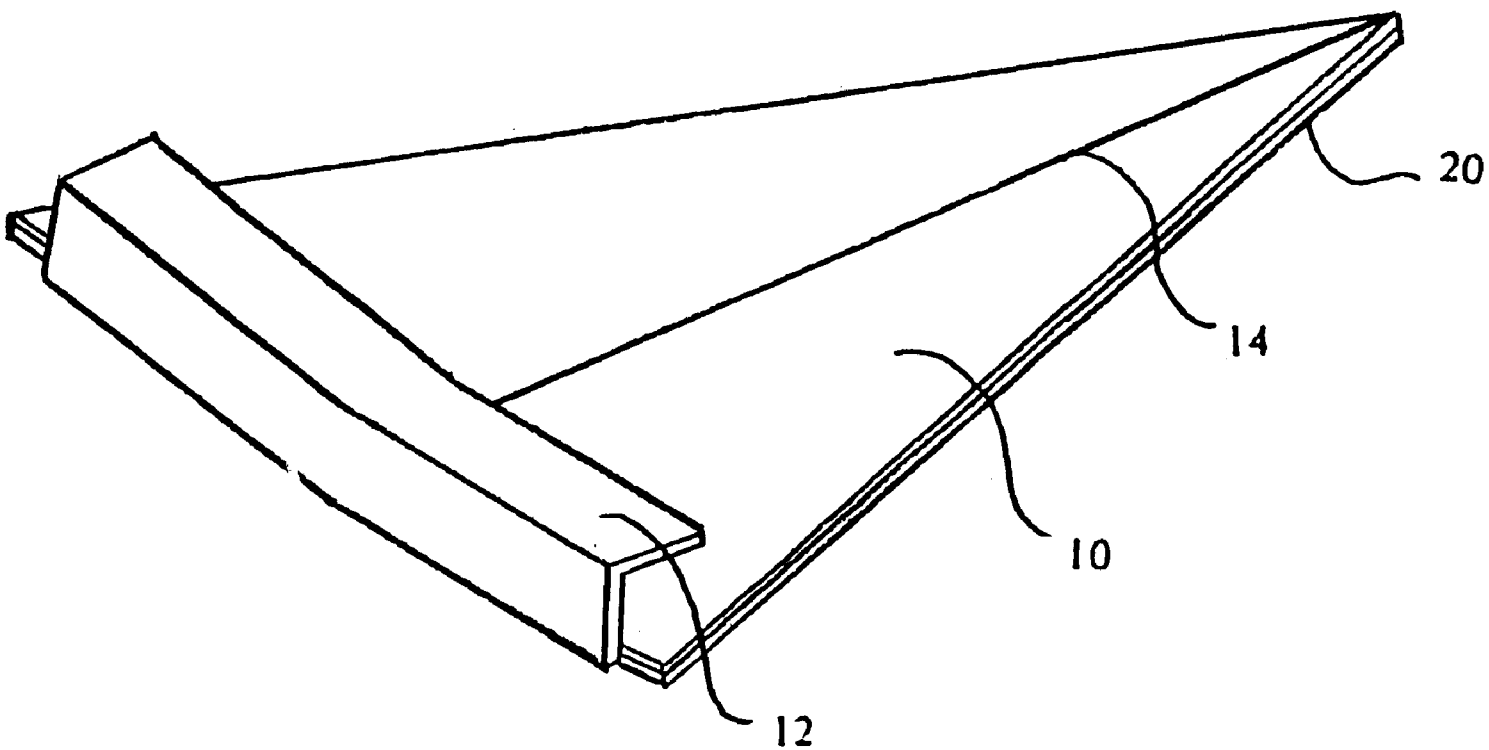
FIG. 1 is a isometric view of the pizza server.

10 pizza server
12 fold-over flap
14 crease
16 perforation/pull string
18 tin strips
20 absorbent lining
22 sleeve
24 cross-wise perforations

SUMMARY

A method for eating pizza, which thanks to the unique design of the pizza server, allows for a neater, handier way of handling this fun food, being that, pizza is the type of food favored at parties, concerts, fairs, sports events, etc . . . , often, in a setting which is not conducive to sitting at a table with utensils to eat it, this pizza server invention will fit right into the scene. Furthermore, the pizza server may serve as a novel method for advertising and generating good will, that will benefit pizza parlours that freely hand them out.

PREFERRED EMBODIMENT

Description

Disposable Model

FIG. 1 shows us the isometric view of the pizza server 10, where the pizza slice sets on top and the crust sets inside the fold-over flap 12 along the back end. The crease 14, along the center of the server allows for the pizza slice to be folded lengthwise so it doesn't flop.(Note the slight angle along the backside at the center of the pizza server.)

One could hold the pizza slice by the flap, thereby avoiding getting one's hands dirty, and also, it provides insulation from handling the hot pizza.

The pizza server 10 has an absorbent lining 20 incorporated all along the top of the plate to absorb any grease.

Figure 2:
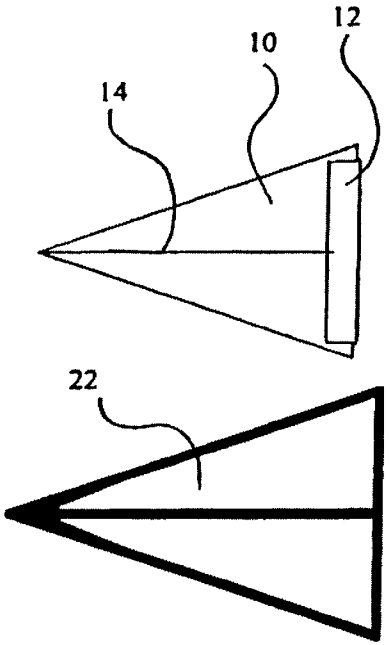
FIG. 2 is a top view of the pizza server with sleeve

FIG. 2 shows the top view of the pizza server 10 along side with a sleeve 22 that serves to contain the pizza slice and the pizza server 10.

Figure 3:
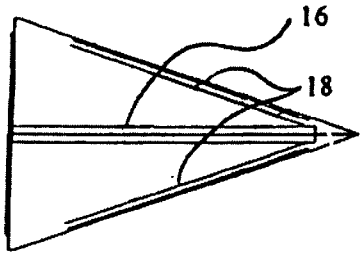
FIG. 3 is a bottom view of the pizza server.

FIG. 3 shows the bottom view where we see the, pull string 16 taped along the crease, so that, as one consumes the slice of pizza, by pulling back on the pullstring underneath, he seperates the pizza server along the angled crease and allows for the newly seperated sections to be folded back giving the consumer access to more pizza. (This function may also be served well with a simple perforation cut into the plate at the crease.)

The tin strips 18 that are adhered to the bottom of the pizza server on either side, provide some stiffness to the pizza server, and facilitate the folding back and away of the two newly seperated sides in that once one has folded back the pizza server, thanks to the tin, it stays folded and away from the area where the pizza is being eaten.

Figure 4:
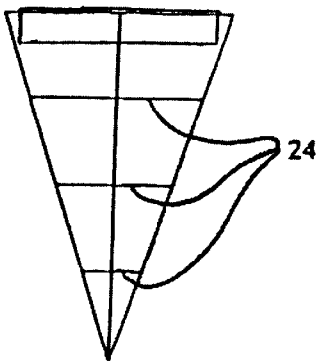
FIG. 4 is a top view of an alternative peel-away version

FIG. 4 shows the top view of a peel-away version using crosswise perforations 24 is discussed under other embodiments.

PREFERRED EMBODIMENT

Operation

The pizza server functions as a way to serve pizza which allows for this fun food to be enjoyed at parties and concerts and sports events, without the cumbersome need to provide tables and chairs and utensils.

A simple operation of inserting the pizza server 10 under the slice of pizza at the pie, and then using the fold-over flap 12 to envelope the crust of the pizza, and then bending the plate along the crease 14, so that the pizza slice remains rigid as you pick it up.

Then, you peel back the bottom of the plate from the area where the pizza gets consumed by tearing along the center lengthwise perforation or pull-string 16 at the crease 14, bit by bit, in order to fold back both halves of the plate, as the pizza gets consumed.

Furthermore, this invention has the added operation of being used as an advertising medium. That is, by imprinting on the plate itself, the pizza vendors advertisements thereby creating a new mode for advertising and generating goodwill with his business.

The pizza sleeve 22 serves to assist in carrying the slice of pizza while keeping it warmer, longer and absorbs excess pizza grease. This sleeve 22 also allows for stacking one atop another.

OTHER EMBODIMENTS

Non-disposable Plate

Description

This non-disposable plate 10 will be made of plastic. and has the same shape as the main embodiment, that of a pizza wedge.

It functions in the same manner as the disposable version in that, it uses a crease 14, a flap 12, and it retracts as the pizza is consumed.

The crease 14 is soft and pliable and stretchable rubber.

The plate 10 is firmer, yet will retract by bending back manually.

The flap 12 as well has the same qualities as does the plate 10 in that, it is firm, yet can be bent manually. There is another crease of the same quality as the crease 14 at the connecting point of the plate 10 and the flap 12.

The plastic and rubber retains its original form once it is straightened back out after it's use, and can be washed and stored for future use.

Non-disposable Plate

Operation

This non-disposable plate10 is inserted under the slice of pizza, at the pie.

Then the flap12 is folded over the crust of the pizza slice.

Then the pizza is folded along the crease14 at center lengthwise a little bit to prevent the pizza's flopping down.

Then the plate10 with the pizza slice in it is raised.

Then the plate10 underneath is folded back as the pizza is being consumed.

The rubber at the crease 14 stretches to allow the two halves of the plate, now planed at different angles from each other, to fold back.

Peel-away Disposable Version

Description

In this version, the bottom of the the pizza-server 10, has cross-wise perforations 24 every two inches, so that, as the pizza is being consumed, one tears away each section, till the pizza is finished.

This version eliminates the need for tin strips 18, embedded within the plate 10, as the fold-away feature would no longer be necessary.

Peel-away Disposable Version

Operation

One inserts the pizza-server 10 under the slice of pizza at the pie. With the fold-over flap 12, the pizza-lover wraps the crust, and then, folds the pizza-server 10 lengthwise along the crease 14.

Using the cross-wise perforations 24, the pizza-lover then peels away the first two inches of the bottom of the pizza-server 10, located at the narrow end, to make the slice of pizza ready for consumption. As the pizza is consumed, the pizza-server is peeled away two inches at a time.

Conclusions, Ramifications, and Scope

Accordingly, it can be seen that the pizza server, will make for an exciting new way to serve this fun food. In a simple fashion, one inserts the plate 10 under the slice of pizza, and then, using the flap 12, he grabs the crust and folds the slice of pizza along the crease 14, to pick it up. Then, if needed, he inserts it into the sleeve22.

This already fun food will be even more fun to consume.

Although the description above contains many specificities, these should not be construed as limiting the scope of the invention but as merely providing illustrations of some of the presently preferred embodiments of this invention. Various other embodiments and ramifications are possible within it's scope.

Thus the scope of the invention should be determined by the appended claims and their legal equivalents, rather than by the examples given.

What is claimed is:

1. A plate comprising a thin, flat, wedge-shaped body of material that follows the contour of a slice of pizza, that is slid underneath said slice of pizza at the pizza pie, wherein said body has a crease built in, along the center, lengthwise of said body, for the purpose of folding said slice of pizza along it's length, thereby keeping said slice from flopping down as said slice is picked up for consumption, and wherein said crease further includes, a means selected from the group consisting of pull-strings and perforations, to tear said plate along said crease, so that, as said slice of pizza is being consumed, one could tear said plate at said crease and allow for each half of said plate, now planed at different angles in relation to each other, to be peeled away from the bottom of said slice of pizza at the area of consumption.

2. The plate of claim 1 wherein said body of material is made of a disposable material selected from the group consisting of cardboard, paper and foam.

3. The plate of claim 2 further comprises means, selected from the group consisting of tin wire and aluminum foil, is embedded within said plate, or adhered to the bottom of said plate, so as to give said plate the necessary quality that would keep said plate folded away after said plate is peeled away from the bottom of said slice of pizza at the area of consumption.

4. The plate of claim 1 further comprises a sleeve made of the same material as said material for said plate, is provided on which to insert said slice of pizza as it sets on said plate, for the dual purpose of helping to keep said slice warmer, longer, as well as to facilitate the transport of one or several of said slices, stacked one atop the other.

5. The plate of claim 4 further comprises means for absorbing excess grease from said slice of pizza, either by an absorbent liner being added to said plate and within said sleeve, or by being a built-in feature of said body of material.

6. The plate of claim 4 further comprises printed indicia on said plate and said sleeve.

7. The plate of claim 1 wherein said body has a fold-over flap built into the wider end of said body to wrap over the crust of said slice of pizza for the purpose of picking up said slice.

8. The plate of claim 1, comprising a thin, flat, body of material wherein said plate may be utilized for the consumption of foods, selected from the group consisting of sub sandwiches and stuffed pitas.

9. A plate comprising a thin, flat, wedge-shaped body of material that follows the contour of a slice of pizza, that is slid underneath said slice of pizza at the pizza pie, wherein said body has a crease built in, along the center, lengthwise of said body, for the purpose of folding said slice of pizza along it's length, thereby keeping said slice from flopping down as said slice is picked up for consumption, further includes, a plurality of cross-wise perforations would be used on said plate, about every two inches, for the purpose of peeling away small sections of said plate as said slice of pizza is being consumed and wherein said plate is made of a disposable material selected from the group consisting of cardboard, paper and foam.

10. A method for eating a slice of pizza, comprising:

a. providing a wedge-shaped plate which is made of a disposable material selected from the group comprising of paper, cardboard, and foam, that is slid underneath said slice of pizza at the pizza pie, and b. providing a fold-over flap located on the wider end of said plate to wrap over the crust of said slice of pizza, for the purpose of picking up said slice, and c. providing a centered, lengthwise crease on said plate, for the purpose of folding said slice along it's length thereby keeping said slice from flopping as said slice is picked up, and d. providing a means to tear said plate along said crease that would be selected from the group consisting of pull-strings and perforations, so that, as said slice of pizza is being consumed, one could tear said plate at said crease and allow for each half of said plate, now planed at different angles in relation to each other, to be peeled away from the bottom at the area of consumption, and e. providing a means, selected from a group consisting of tin wire and aluminum foil, embedded within said plate so as to give said plate the necessary quality that would keep said plate folded away after said plate is peeled away from the bottom of said slice of pizza at the area of consumption, and g. providing a sleeve to insert said slice of pizza as it sets on said plate, made of same said material for the dual purpose of helping to keep said slice warmer, longer, as well as to facilitate the transport of one said slice or several of said slices, stacked one atop the other, and h. providing an absorbent lining, by the means of either being added onto said plate and within said sleeve, or being made a built-in feature with regards to the quality of the said plate and said sleeve material, for the purpose of absorbing excess pizza grease, whereby one may eat said slice of pizza in a casual fashion unhindered by the need to sit down at a table with utensils, as such occasions do present themselves at parties, concerts, sports events, etc., and whereby one may more easily distribute said slices of pizza with the use of said sleeve, and, whereby said slices of pizza may be kept warmer longer with the use of said sleeve, and, whereby said pizza may result in having fewer calories because of the said excess grease being removed by said absorbent material of said plate and said sleeve, and, whereby both said pizza server plate and said sleeve may be utilized as a method for advertising, by imprinting information on said plate and said sleeve, and, whereby both said pizza server plate and said sleeve may be utilized as a method for generating good will, by being freely handed out to customers.

11. The method of claim 10 wherein, an alternative embodiment would provide cross-wise perforations along said plate about every two inches, whereby allowing one to progressively tear away the said plate as the pizza is getting consumed.

12. The method of claim 10 wherein, an alternative embodiment of said plate is for said plate to be made of pliable plastic material and said crease made of elastic material facilitating said plastic plate being folded back as the pizza is being consumed, whereby said plate is re-usable.

13. The method of claim 10 wherein, said plate can accommodate food selected from the group consisting of sub-sandwiches and stuffed pitas.

14. A plate comprising a thin, flat, wedge-shaped body of material that follows the contour of a slice of pizza, that is slid underneath said slice of pizza at the pizza pie, wherein said body has a crease built in, along the center, lengthwise of said body, for the purpose of folding said slice of pizza along it's length, thereby keeping said slice from flopping down as as said slice is picked up for consumption, and wherein as an alternative to disposable materials being used, said plate is made of pliable plastic, so as to be re-usable, with said crease being made with elastic material to facilitate folding back said plastic plate for consumption of the pizza.

* * * * *